US005592276A

United States Patent [19]

Ohtsuka et al.

[11] Patent Number: 5,592,276

[45] Date of Patent: Jan. 7, 1997

[54] IMAGE FIXING DEVICE WITH HEATER RESPONSIVE TO THERMAL STRESS

[75] Inventors: Yasumasa Ohtsuka; Shunji Nakamura; Kouichi Okuda, all of Yokohama; Yohji Tomoyuki, Ichikawa; Akira Hayakawa; Daizo Fukuzawa, both of Tokyo, all of Japan

[73] Assignee: Canon Kabushiki Kaisha, Tokyo, Japan

[21] Appl. No.: 253,608

[22] Filed: Jun. 3, 1994

Related U.S. Application Data

[63] Continuation of Ser. No. 977,025, Nov. 16, 1992, abandoned.

[30] Foreign Application Priority Data

Nov. 14, 1991 [JP] Japan ..... 3-298987
Oct. 21, 1992 [JP] Japan ..... 4-283051

[51] Int. Cl.[6] ..... G03G 15/20; H01H 85/00

[52] U.S. Cl. ..... 339/335; 200/61.08; 219/216; 337/403; 338/307; 399/33

[58] Field of Search ..... 355/285; 219/216, 219/469, 543, 517; 200/61.08; 338/307, 308, 195, 24, 203, 316; 337/403, 404, 405, 407

[56] References Cited

U.S. PATENT DOCUMENTS

| | | | |
|---|---|---|---|
| 2,263,752 | 11/1941 | Babler | 200/131 |
| 3,978,443 | 8/1976 | Dennis et al. | 338/309 |
| 4,208,645 | 6/1980 | Harmon et al. | 337/297 |
| 4,562,509 | 12/1985 | Lindgren | 219/509 X |
| 4,961,065 | 10/1990 | Taylor | 338/308 |
| 5,083,168 | 1/1992 | Kusaka et al. | 355/285 |
| 5,084,693 | 1/1992 | Taylor et al. | 338/306 |

FOREIGN PATENT DOCUMENTS

| | | |
|---|---|---|
| 63-313182 | 12/1988 | Japan . |
| 2-157878 | 6/1990 | Japan . |
| 3-182090 | 8/1991 | Japan . |
| 3-182089 | 8/1991 | Japan . |

*Primary Examiner*—Nestor R. Ramirez
*Attorney, Agent, or Firm*—Fitzpatrick, Cella, Harper & Scinto

[57] ABSTRACT

A heater includes a base plate, and a resistor, extending in a longitudinal direction of the base plate, for generating heat when a power supply is applied thereto. A recess, such as a hole or groove, is formed in the base plate in a longitudinal portion of the resistor, to bias the base plate to break at the longitudinal portion and to open a circuit including the power supply and the resistor, to safely prevent overheating or smoking of the heater.

30 Claims, 9 Drawing Sheets

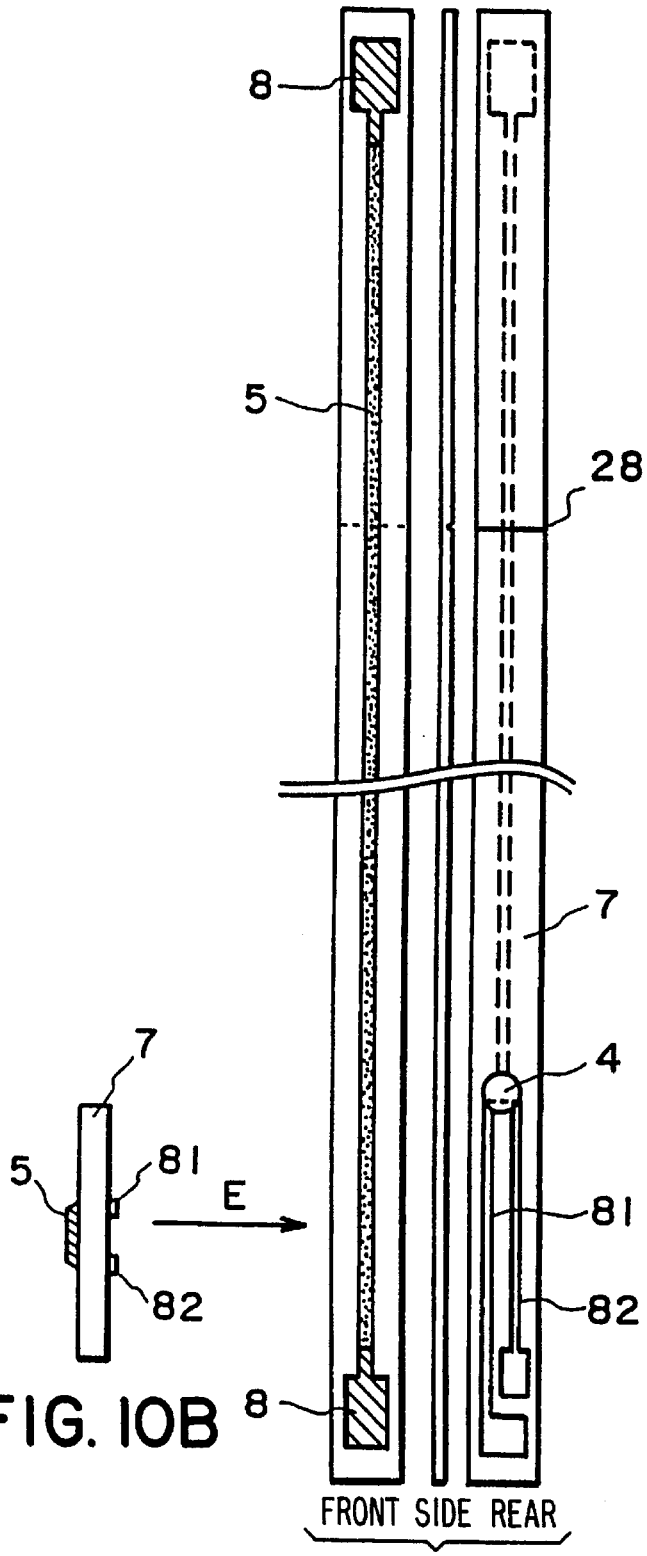
FIG. 10B
FIG. 10A
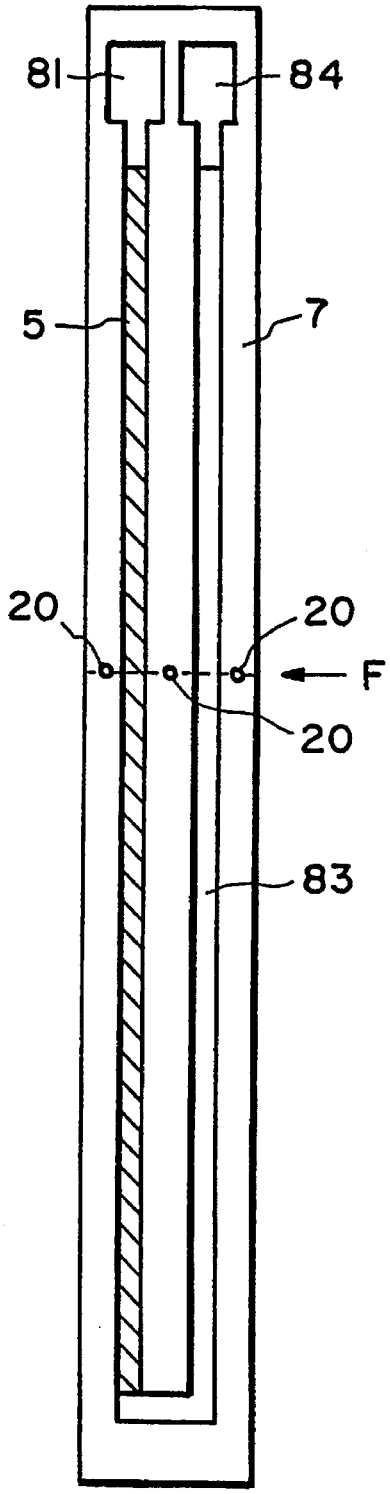
FIG. 11

IMAGE FIXING DEVICE WITH HEATER RESPONSIVE TO THERMAL STRESS

This application is a continuation of application Ser. No. 07/977,025 filed Nov. 16, 1992, now abandoned.

FIELD OF THE INVENTION AND RELATED ART

The present invention relates to a heater having a base plate and a resistor layer and an image fixing apparatus using the heater.

Recently, as a heat fixing apparatus replaceable with a heat roller type image fixing apparatus, Japanese Laid-open Patent Applications Nos. 313182/1988 and 157787/1990 propose a device having a quick response thermal heater and a thin film.

FIG. 1 shows a heater 6 used in such a device. A base plate 7 in a linear form is made of alumina having a high heat conductivity. A heat generating resistor 5 is supplied with electric power from a voltage source E (not shown) through an electrode at the longitudinal ends thereof. The heat generating resistor 5 is mounted on the base plate 7 extending in the longitudinal direction thereof. A fuse (not shown) also is provided.

If the heater malfunction for some reason or another with the result of unintentional temperature rise, and if the temperature rise is to high, the heater temperature might significantly exceed the fuse operating temperature, before the fuse operates correctly, with the result of damage or smoking thereof.

Upon such a temperature rise of the heater 6, the resistor 5 may be cracked due to thermal stress. If this occurs, the resistance at the cracked portion increases so that the quantity of heat generation is large, and there arises a problem that the cracked portion smokes or catches fire prior to operation of the fuse.

If the base plate is broken by the thermal stress, the resistor is separated so that the heat generation is stopped. However, where the thickness of the resistor is large or where the base plate is securedly fixed on a holder, the resistor is not completely separated, in which case, the electric power supply continues, as the case may be.

Because of the higher resistance of the cracked portion, the portion may smoke or catch fire.

SUMMARY OF THE INVENTION

Accordingly, it is a principal object of the present invention to provide a heater and image fixing apparatus wherein a predetermined portion of the heater is deliberately cracked upon malfunction of the heater.

It is another object of the present invention to provide a heater and image fixing apparatus wherein heat generation is stopped instantaneously upon malfunction of the heater.

It is a further object of the present invention to provide a heater and image fixing apparatus wherein a recess or groove is provided in a longitudinal range of the heater.

It is a further object of the present invention to provide a heater and image fixing apparatus wherein an overheat preventing element is disposed at such a position relatively more sensitive to stress than other positions in the heat generating zone of the heater.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 10A includes is a top plan view, a side view and a bottom plan view, and FIG. 10B is a sectional view of a heater according to another embodiment of the present invention.

FIG. 11 is a top plan view of a heater according to a further embodiment of the present invention.

DESCRIPTION OF THE PREFERRED EMBODIMENTS

Figure 1:
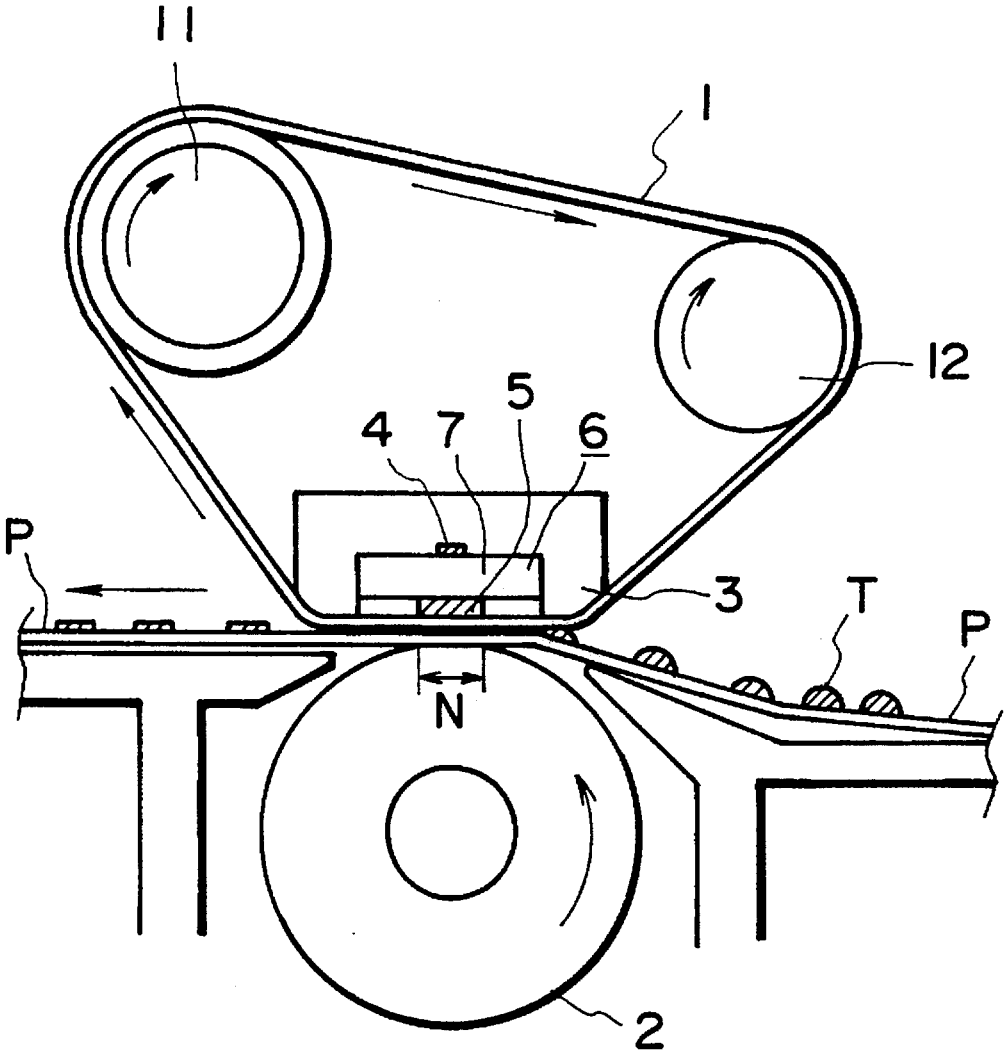
FIG. 1 is a sectional view of an image fixing apparatus according to an embodiment of the present invention.

Referring to FIG. 1, there is shown an image fixing apparatus according to an embodiment of the present invention. The image fixing apparatus comprises heat resistive film (sheet) 1 having a small thickness, a driving roller 11 for driving the film 1, a constant temperature heater 6 fixedly mounted on a frame at one side of the heater 6, and a pressing member 2 for urging an image bearing surface of a recording material P to the film 1, wherein at least during the fixing operation, the film 1 is driven to travel substantially at the same peripheral speed and in the same peripheral direction as the recording material P which is passed through the nip (fixing position) formed between the film 1 and the pressing member 2. The image bearing surface of the recording material P is heated by the heat generated by the heater 6 through the film 1 to apply heat to a visualized (unfixed toner) image to fuse and fix it on the recording material P. After the recording material P passes through the fixing position, the recording material P is separated from the film 1 at a separating point. Designated by reference numeral 12 is a tension roller for applying tension to the film 1. Designated by reference numeral 3 is a holder for insulatively supporting the heater 6, and the heater 6 is bonded to the holder and extends in the longitudinal direction thereof. A thermister 4 functions to detect the temperature of the heater. The power supply to the heater is controlled during the fixing operation so that the output temperature of the thermister 4 is constant.

Figure 2:
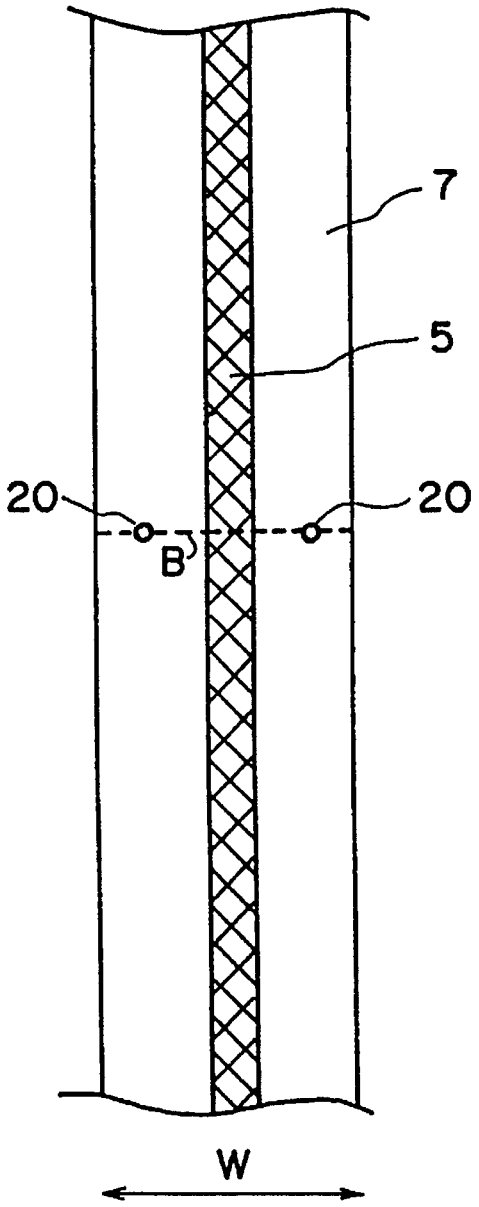
FIG. 2 is an enlarged sectional view of a heater according to an embodiment of the present invention.

Referring to FIG. 2, there is shown a heater according to an embodiment of the present invention. The heater base plate 7 is made of alumina having good thermal conductivity and has a width W=7 mm and a thickness of 1 mm. The heater base plate 7 is provided with through holes 20 adjacent respective lateral sides of the heat generating resistor 5. The holes 20 have a diameter of 0.5 mm.

If the temperature of the heater 6 rises abnormally high, a crack is produced from the holes as indicated by the broken lines B due to the thermal stress, thus quickly breaking the heater 6 including the resistor 5 by which the power supply and the heat generation stops. The holes are not necessarily through holes but may have a depth which is half the thickness of the heater base plate 7.

The number of easy break portions is not limited to one but may be two or more to permit breakage at one position or more.

Figure 3:
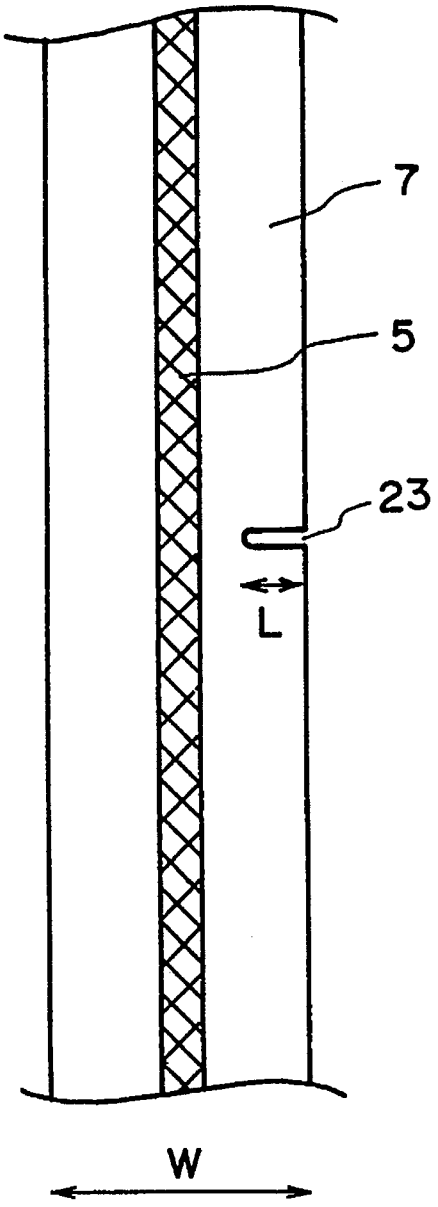
FIG. 3 is a partial enlarged view of a heater according to another embodiment of the present invention.

FIG. 3 shows a heater according to another embodiment. In this embodiment, a cut-away portion 23 having a length L=0.5 mm is formed at one lateral side of a heater base plate 7 having a width W=7 mm. Upon an abnormal temperature rise of the heater, a crack is produced from the cut-away portion to permit the heater to be broken, by which the power supply and the heat generation is stopped.

Figure 4A:
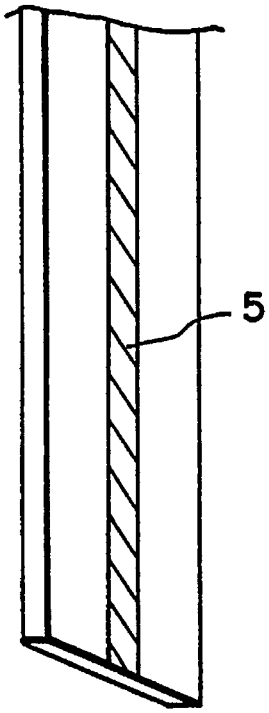
FIGS. 4A and 4B are partial enlarged front and rear views of a heater according to a further embodiment of the present invention.
Figure 4B:
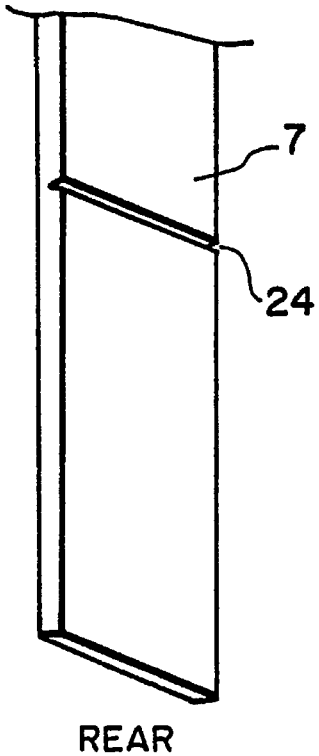

FIGS. 4A and 4B show a further embodiment, in which the heater base plate 7 having a thickness of 0.6 mm is provided with a groove 24, which may be formed by a diamond curer, through ultra-sonic wave processing or the like. As a further alternative, the groove 24 may be formed by fusing by $CO_2$ gas laser. A $CO_2$ gas laser is preferable in that a crack may be produced during manufacturing by the diamond cutter or the ultrasonic wave processing machine, resulting in variation in the ease of breaking due to a high temperature. The variation does not occur in the case of the $CO_2$ gas laser. The groove 24 is formed in the surface opposite from the surface contacting the film and having the heat generating registor 5. This effectively prevents a burr of the groove forming process from damaging the film which is in sliding contact with the base plate.

Figure 5A:
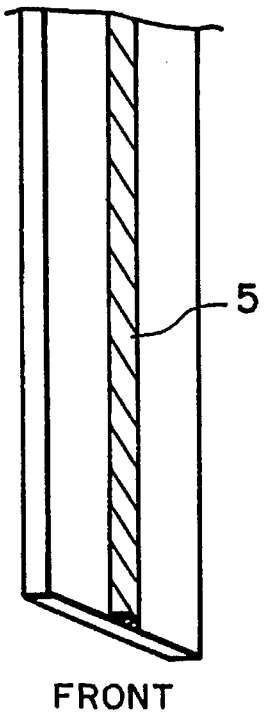
FIGS. 5A and 5B are partial enlarged front and rear views of a heater according to a further embodiment of the present invention.
Figure 5B:
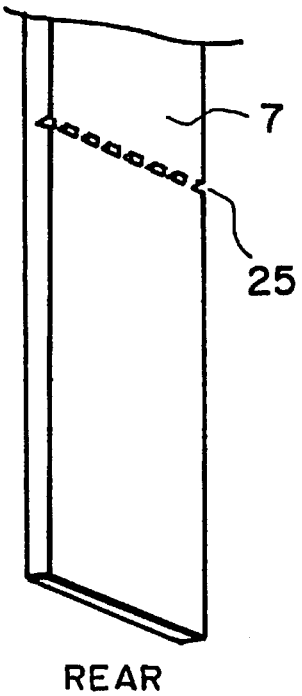

FIGS. 5A and 5B show a further embodiment, in which a groove 25 in the base plate 7 is in the form of a line of dots, which are formed by a $CO_2$ gas laser or YAG a laser in the form of pulses. As compared with the groove 24 of FIGS. 4A and 4B, the groove of this embodiment is not easily broken when the force is not so strong as in the process of manufacturing, but is easily broken upon a strong force, as in the case of thermal stress upon the abnormal temperature rise. In other words, the groove 25 is advantageous in that it is not easily broken during manufacturing but is easily and quickly broken upon the abnormally high temperature rise.

Figure 6:
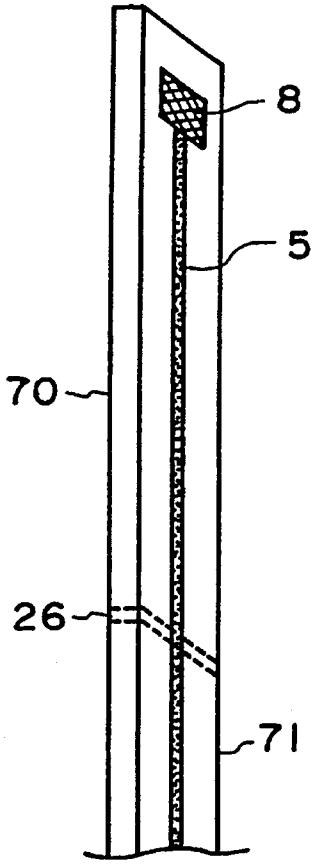
FIG. 6 is a partial enlarged view of a heater according to a further embodiment of the present invention.

FIG. 6 shows a further embodiment, wherein two ceramic base plates 70 and 71 are bonded by an inorganic heat resistive bonding material, and on the bonded base plate, an electric heat generating resistor is formed. Since the mechanical strength of the bonding agent layer 26 is smaller than that of the ceramic base plate, the heater 9 can be broken.

Figure 7A:
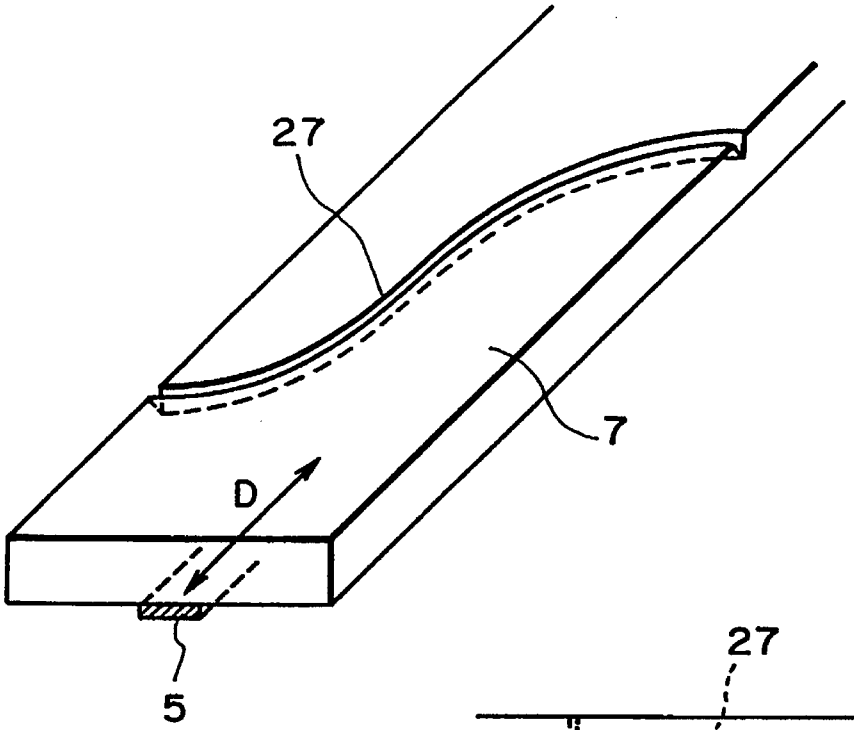
FIGS. 7A and 7B are a partial enlarged view and a schematic view of a heater according to a further embodiment of the present invention.
Figure 7B:
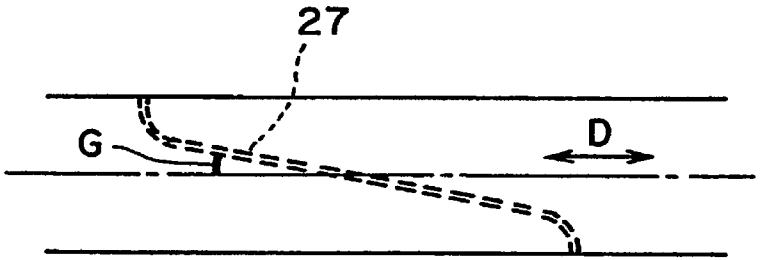

In the embodiment of FIGS. 7A and 7B the groove 27 in the base plate 7 has an S-shape so that there is a part in which an angle G formed between the groove and a direction parallel to the heat generating registor 5 is not more than 45 degrees. With this configuration, the heater can be broken more quickly upon the abnormally high temperature rise.

Figure 8:
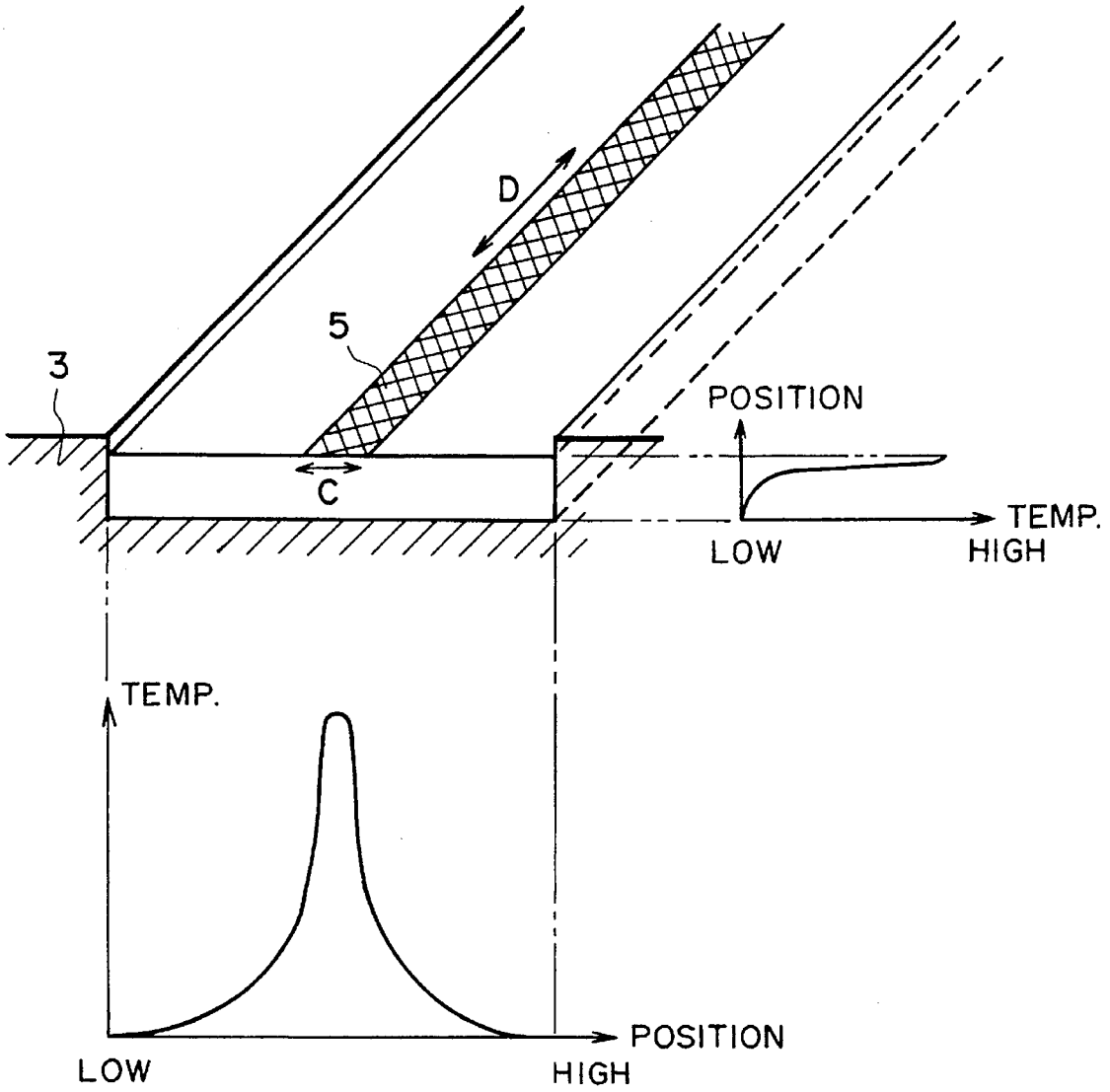
FIG. 8 is a partial enlarged perspective view of a heater and a holder therefor with a temperature distribution graph to illustrate the advantageous effects of the present invention.
Figure 9:
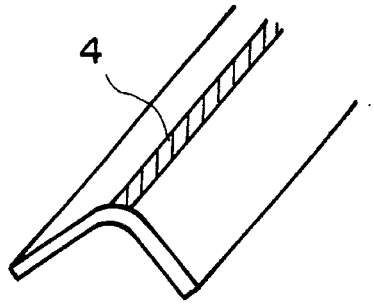
FIG. 9 is a partial enlarged view illustrating advantageous effects of the present invention.

Referring to FIG. 8, the thermal stress break characteristics will be described. With the heater bonded on the holder 3, the heater temperature distribution in the direction of the thickness of the heater is such that the temperature is high on the heat generating registor side, and is low in the opposite side. The temperature distribution in the direction C of the width of the heater is such that a portion having the heat generating registor 5 is high but the lateral end portions are low. The heater thermally expands in accordance with such temperature distributions, and a thermal stress is produced thereby. Then, the heater deforms as shown in FIG. 9, with the result that the stress is high along the heat generating resistor 5. In order to break the heater by this stress, it is preferable that the groove in the back side extends parallel to the heat generating registor 5. The investigations of the inventors have revealed that the parallel effect is substantially advantageous even if complete parallelism does not exist, if the angle formed therebetween is not more than 45 degrees.

FIGS. 10A and 10B show a further example, in which there are provided a thermister 4 and thermister electrodes 81 and 82 on a side opposite from the heat generating resistor 5 side of the base plate 7. The thermister 4 is provided within a width corresponding to the width of the heat generating resistor 5. It is assumed that the temperature responsive fuse does not work for one reason or another. If the heater temperature rises abnormally, then the heater might smoke. It is possible that the heater may finally be broken. On the other hand, the heater may be broken by impact or the like after it is manufactured. It is not predictable under what circumstances a given heater will be broken.

If the heater is broken at the portion indicated by an arrow E, the thermister electrodes and the heat generating resistor 5 are separated only by the thickness of base plate 7, so that a short circuit may be established between the heat generating resistor 5 supplied with an AC voltage and the thermister electrodes 81 and 82. If this occurs, the electric system including the control system will be damaged. In order to avoid this, a groove 28 is formed in the base plate 7 at a position displaced from the thermister 4 and thermister electrodes 81 and 82. By doing so, when the heater is broken upon an abnormally high temperature rise or upon impact, the breakage occurs necessarily at the position of the groove 28.

In the embodiment of FIG. 11, the electric current flows from the electrode 81 through heat generating resistor 5, and through electric path 83 to electrode 84. The base plate 7 having a width of 15 mm is provided with three through holes 20 each having a diameter of 0.8 mm. Upon a abnormally high temperature rise, the break occurs along the broken line F. With this structure, when the heater is broken along the broken line, the electric path between the two points through heat generating resistor 5 and the electric path 83 can be broken. When the heater 2 is broken as shown in FIG. 10, wherein the electric flow path is broken only at one position, an electric discharge may occur at the broken position. This can be avoided in this embodiment.

Figures 12A, 12B, 12C:
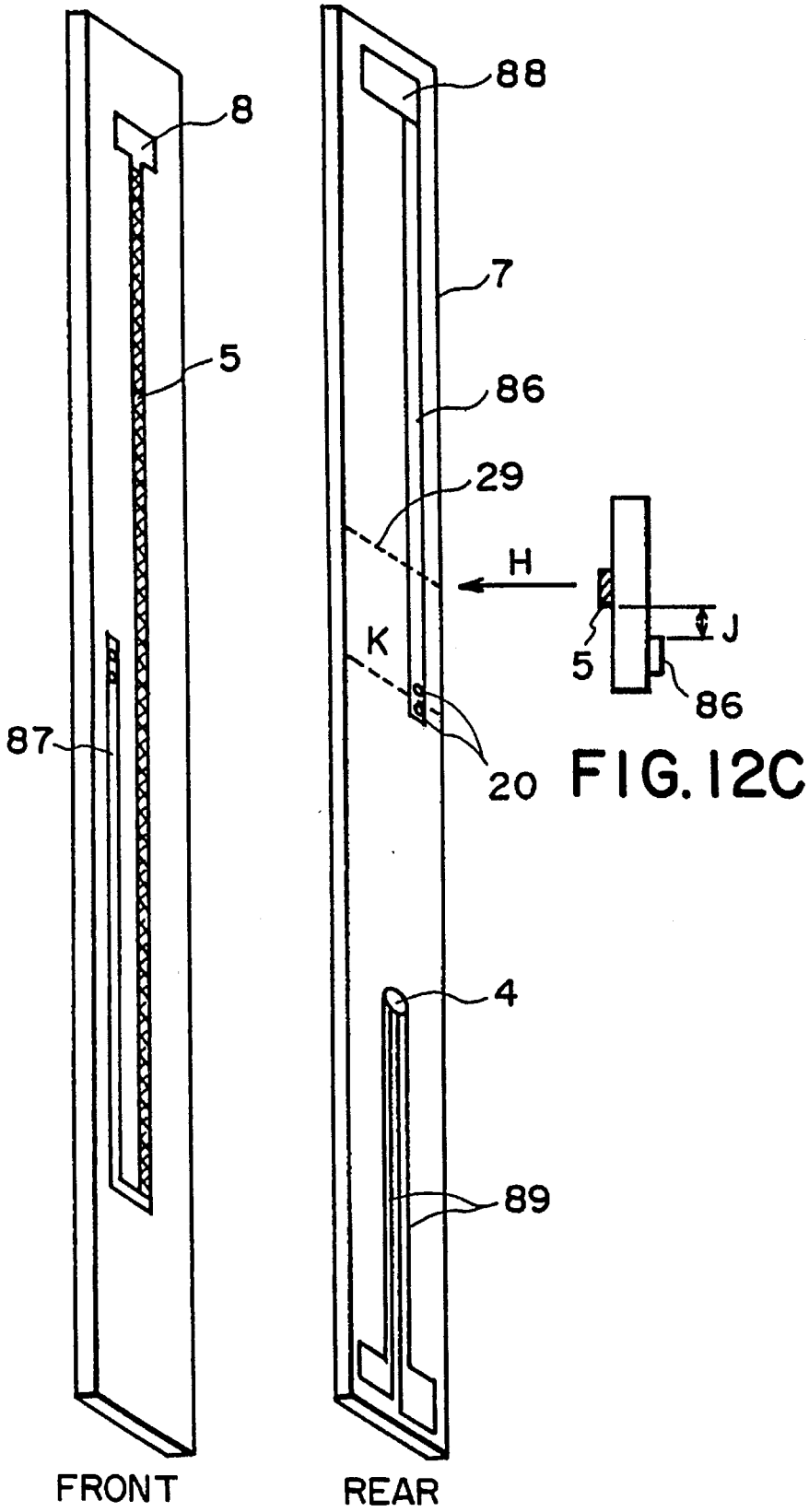
FIGS. 12A, 12B and 12C are front, rear and side perspective views of a heater according to a further embodiment of the present invention.

FIGS. 12A and 12B show a further embodiment, in which the electric current flows through an electrode 8, the heat generating resistor 5, the electric path 87, a through hole 20, and an electric path 86 to an electrode 88. A groove 29 is formed at a position H in the surface of the base plate 7 opposite from a surface having the heat generating resistor 5, which has a width of 1.5 mm. Upon the abnormally high temperature rise, the break occurs at the position H. To avoid a short circuit between the heat generating resistor 5 and the electric path 86 upon the break, the distance J therebetween is not less than 0.5 mm. On the heater, through holes are provided in addition to the groove 29, to permit easy break at the position K.

In the foregoing embodiments, the heater is broken at a predetermined position by the stress. However, as described hereinbefore, it may be possible that even if the base plate is broken the resistor is not broken so that the heat generation continues.

The description will be made as to an embodiment which is safe even if the resistor is not separated despite the break of the base plate.

Figure 13:
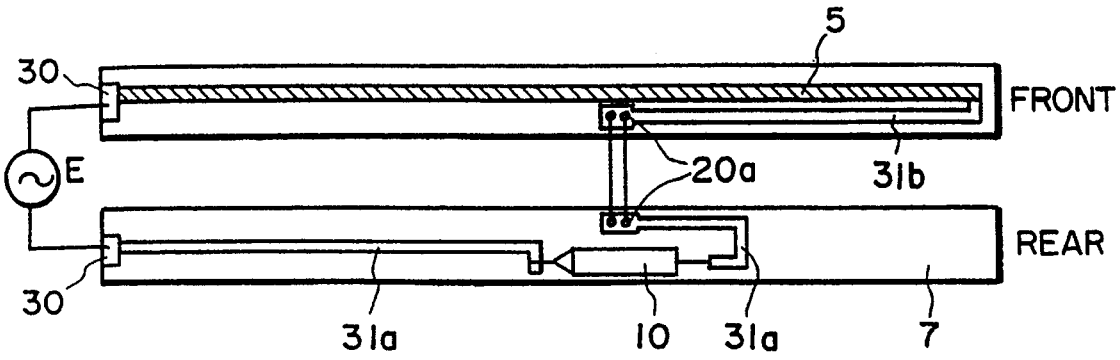
FIG. 13 is a schematic view of the front and rear sides of a heater according to a further embodiment of the present invention.

Referring to FIG. 13, such an embodiment is shown, in which on the front surface the heat generating resistor 5 is provided, the front surface being contactable to the film. On the rear side surface, a fuse 10 is provided to open the power supply circuit to prevent power supply to the heat generating resistor 5 upon an abnormally high temperature rise. The base plate 7 is made of alumina which is a ceramic material having a high heat conductivity, and supports heat generating resistor 5 made of silver-palladium paste.

Power supply line patterns 31*a* and 31*b* and through holes 20*a* may be made by screen-printing the pattern with silver paste and sintering the pattern. Designated by reference numeral 30 is a contact on each side of a heater and is connected with unshown connector. The fuse 10 is mounted at the same longitudinal position of the base plate 7.

When the power supply to the heater becomes uncontrollable, the temperature rises abnormally, and the thermal fuse operates to stop the power supply. When the through holes are provided in the base plate, the position of the through holes is most quickly responsive to the stress in the heat generating zone of the heater due to the difference in the thermal expansions between conductive member such as silver paste or the like painted in the holes and the base plate. Therefore, when the base plate is broken, it is broken at the through hole position. If the fuse is disposed at the through hole position in the longitudinal direction of the heater, the power supply is most quickly shut off.

The description will be made as to the difference of the operation of the thermal fuse between the FIG. 13 embodiment and a comparison example wherein the fuse is located away from the through hole by not less than 10 cm. In experiments, the temperature of the heater is detected when the fuse operates under the condition that the voltage continues to be supplied without temperature control of the heater. During a fixing operation, the heater temperature is controlled to be 180 degrees (C). The rated operating temperature of the fuse is 210 degrees (C). In these experiments, the structure of the heater was such that the resistor did not separate even if the base plate was broken.

In the comparison example, the fuse did not operate even if the heater was broken, and finally, the fixing device smoked.

In the case of the heater according to this embodiment, the fuse operated when the thermister mounted on the heater detected 300 degrees (C). No smoking or burning occurred.

Thus, according to the present invention, the safety of the apparatus can be assured even if the heater malfunctions.

Figure 14:
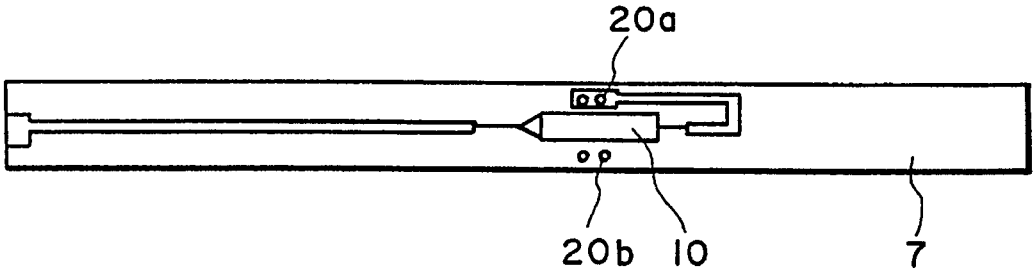
FIG. 14 is a top plan view of a heater according to a further embodiment of the present invention.

FIG. 14 is a bottom plan view of a heater according to a further embodiment of the present invention. In this embodiment, the heater it comprises through holes 20*a* for power supply wiring to the rear side of the heater and, in addition, comprises through holes 20*b* not having the wiring permitting function as contrasted to the through holes 20*a*, at the same longitudinal position as the thermal fuse and at the opposite position from the through holes 20*a* across the fuse. By increasing the number of the through holes in this manner, the position of the fuse is further quickly responsive to the stress.

In the fixing apparatus using the heater according to the present invention, the thermal capacity of the heater 6 is made smaller. So, if the fuse 10 or the like is contacted thereto, the heat is dissipated to the fuse 10 or the like, with the result that the temperature of the heater decreases only at the position having the fuse 10. However, by selecting a proper size and number of the through holes 20*b*, the thermal capacity of the heater at the portion contacted to the fuse can be reduced to compensate for the heat dissipated to the fuse 10, thus permitting further delay in response when the apparatus malfunctions.

In this embodiment, the through holes do not have the function of permitting wiring for the power supply, but it is a possible alternative to provide a groove or recess not penetrating through the heater base 7 to reduce the thermal capacity and to decrease the mechanical strength of the heater.

Figure 15A:
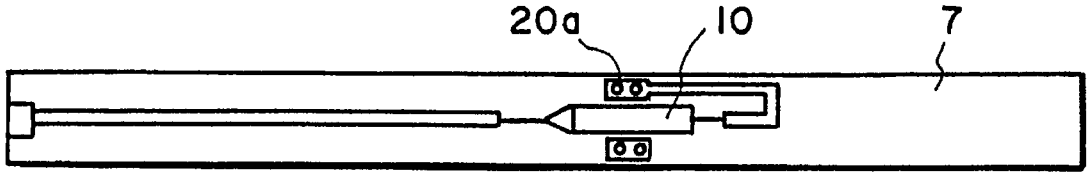
FIGS. 15A and 15B are a top plan view and a partial enlarged view of a heater according to a further embodiment of the present invention.
Figure 15B:
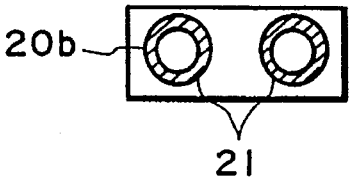

FIGS. 15A and 15B show a further embodiment, wherein FIG. 15A is a top plan view, and FIG. 15B is a partial enlarged view. In this embodiment, the through holes 20*b* are filled with a material 21 having a larger thermal expansion coefficient than the material of the base plate. In this embodiment, the heater base 7 is made of alumina, and the material 21 is silver. However, if the through holes are completely filled with the silver, then the heater will be broken even during normal use. Therefore, it is preferable that the material 21 is in the form of a pipe and is inserted along the inside of the hole. Then, the heater is not broken during usual use, but during heater malfunction, the material tends to break the heater since it has a larger thermal expansion coefficient. This further decreases the strength, against the stress, of the fuse mounting position of the heater.

Figure 16:
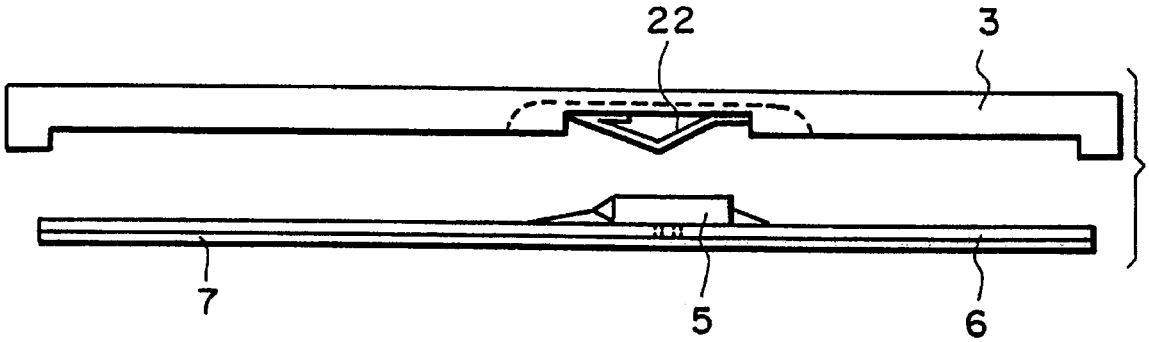
FIG. 16 is an exploded perspective view of a heater according to a further embodiment of the present invention.

FIG. 16 shows a further embodiment. This Figure shows the state before the heater 3 is mounted on a holder. In this embodiment, a leaf spring 22 is mounted on the holder at a position corresponding to the fuse to normally apply pressure. The leaf spring 22 is effective to promote breaking of the heater at the fuse mounting position upon impact thereto or heater malfunction. This embodiment is particularly effective against a strong external impact.

It is preferable that both the embodiment structure effective to the mechanical stress and the embodiment effective to the thermal stress are combined.

The power supply to the overheat preventing element may be made through a lead wire having a heat resistive property. However, from the standpoint of thermal safety, it is preferable that the power is supplied through a power supply pattern.

While the invention has been described with reference to the structures disclosed herein, it is not confined to the details set forth and this application is intended to cover such modifications or changes as may come within the purposes of the improvements or the scope of the following claims.

What is claimed is:

1. A heater comprising:

a base plate having a length and a width;

a resistor, having a length extending in a direction of the length of said base plate, for generating heat when electric energy is supplied thereto; and a recess, formed in said base plate in a range of the length of said resistor and extending through only a portion of the width of the base plate in a direction substantially perpendicular to a direction of current flow through the resistor, wherein said base plate is biased to break at said recess, and said resistor is biased to break and separate at said recess along a line generally perpendicular to the direction of current flow through said resistor.

2. A heater according to claim 1, further comprising an overheating preventing element for preventing overheating of said heater, said element being provided adjacent said recess.

3. A heater according to claim 1, further comprising an electric path disposed on a side of said heater which is opposite from a resistor side of said base plate, and arranged outside said recess relative to said resistor, for supplying electric power to said resistor.

4. A heater as recited in claim 1, wherein said recess is selected from one of a hole and a groove.

5. A heater as recited in claim 1, wherein said recess comprises a plurality of holes.

6. An image fixing apparatus comprising:

a heater comprising a base plate having a length and width, and a resistor having a length extending in a direction of the length of said base plate, for generating heat when electric energy is supplied thereto;

a film having one side in sliding contact with said heater and an opposite side in sliding contact with a recording material carrying an unfixed toner image, wherein the toner image is fixed by heat from said heater through said film; and a recess, formed in said base plate in a range of the length of said resistor and extending through only a portion of the width of the base plate in a direction substantially perpendicular to a direction of current flow through the resistor, wherein said base plate is biased to break at said recess, and said resistor is biased to break and separate at said recess along a line generally perpendicular to a direction of current flow through said resistor.

7. An apparatus according to claim 6, further comprising an overheating preventing element for preventing overheating of said heater, said element being provided adjacent said recess.

8. An apparatus according to claim 6, further comprising an electric path disposed on a side of said heater which is opposite from a resistor side of said base plate and arranged outside said recess relative to said resistor, for supplying electric power to said resistor.

9. An image fixing apparatus as recited in claim 6, wherein said recess is selected from one of a hole and a groove.

10. An image fixing apparatus as recited in claim 6, wherein said recess comprises a plurality of holes.

11. A heater comprising:

a base plate;

a resistor, extending in a longitudinal direction of said base plate, for generating heat when a power supply is applied thereto;

a pair of electrodes, provided at opposite end portions of the resistor, for supplying electric power to said resistor;

stress application means for applying a mechanical stress at a position of said base plate which is more responsive to a mechanical stress than any other position in a longitudinal direction of said base plate between said pair of electrodes.

12. A heater according to claim 11, further comprising an overheating preventing element for preventing overheating of said heater, said element being provided adjacent said stress application means.

13. A heater according to claim 11, further comprising an electric path disposed on a side of said heater which is opposite from a resistor side of said base plate, and arranged outside said stress application means relative to said resistor, for supplying electric power to said resistor.

14. A heater as recited in claim 11, wherein a hole or a groove is formed in said base plate at the position which is more responsive to mechanical stress.

15. A heater as recited in claim 11, wherein a plurality of holes are formed at the position which is more responsive to mechanical stress.

16. An image fixing apparatus comprising:

a heater comprising a base plate and a resistor, extending in a longitudinal direction of said base plate, for generating heat when a power supply is applied thereto;

a pair of electrodes, provided at opposite end portions of said resistor, for supplying electric power to said resistor;

a film movable together with a recording material supporting an unfixed image, wherein the image is fixed by heat from said heater; and stress application means for applying a mechanical stress at a position of said base plate which is more responsive to a mechanical stress than any other position in a longitudinal direction of said base plate between said pair of electrodes.

17. An apparatus according to claim 16, further comprising an overheating preventing element for preventing overheating of said heater, said element being provided adjacent said stress application means.

18. An apparatus according to claim 16, further comprising an electric path disposed on a side of said heater which is opposite from a resistor side of said base plate, and arranged outside said stress application means relative to said resistor, for supplying electric power to said resistor.

19. An image fixing apparatus as recited in claim 16, wherein a hole or a groove is formed in said base plate at the position which is more responsive to mechanical stress.

20. An image fixing apparatus as recited in claim 16, wherein a plurality of holes are formed in said base plate at the position which is more responsive to mechanical stress.

21. A heater comprising:

a base plate having a length and a width;

a resistor, having a length extending in a direction of the length of said base plate, for generating heat when electric energy is supplied thereto;

a recess, formed in said base plate at a position in a range of the length of said resistor, wherein said base plate is biased to break at the position of said recess, and said resistor is biased to break and separate at the position of said recess along a line generally perpendicular to a direction of current flow through said resistor; and an overheating preventing element for shutting off the power supply to said resistor, said overheating preventing element being disposed at a position adjacent to the position of said recess.

22. A heater as recited in claim 21, wherein said recess is selected from one of a hole and a groove.

23. A heater as recited in claim 21, wherein said recess comprises a plurality of holes.

24. An image fixing apparatus comprising:

a heater comprising a base plate having a length, and a resistor having a length extending in a direction of the length of said base plate, for generating heat when electric energy is supplied thereto;

a film having one side in sliding contact with said heater, and an opposite side in sliding contact with a recording material carrying an unfixed toner image, wherein the toner image is fixed by heat from said heater through said film;

a recess, formed in said base plate at a position in a range of the length of said resistor, wherein said base plate is biased to break at the position of said recess, and said resistor is biased to break and separate at the position of said recess along a line generally perpendicular to a direction of current flow through said resistor; and an overheating preventing element for shutting off the power supply to said resistor, said overheating preventing element being disposed at a position adjacent to the position of said recess.

25. An image fixing apparatus as recited in claim 24, wherein said recess is selected from one of a hole and a groove.

26. An image fixing apparatus as recited in claim 24, wherein said recess comprises a plurality of holes.

27. A heater comprising:

a base plate;

a resistor, extending in a longitudinal direction of said base plate, for generating heat when a power supply is applied thereto;

pressing means for applying pressure to said base plate locally at a position within a range of a length of said resistor; and an overheating preventing element for shutting off the power supply to said resistor;

wherein said overheating preventing element is located at the same position as said pressing member with respect to a longitudinal direction of said base plate.

28. An apparatus according to claim 27, wherein said pressing member includes a leaf spring.

29. An image fixing apparatus comprising:

a heater, said heater comprising a base plate and a resistor, extending in a longitudinal direction of said base plate, for generating heat when a power supply is applied thereto;

a film movable together with a recording material supporting an unfixed image, wherein the image is fixed by heat from said heater;

pressing means for applying pressure to said base plate locally at a position within a range of a length of said resistor; and an overheating preventing element for shutting off the power supply to said resistor, wherein said overheating preventing element is located at the same position as said pressing member with respect to a longitudinal direction of said base plate.

30. An apparatus according to claim 29, wherein said pressing member includes a leaf spring.

* * * * *

UNITED STATES PATENT AND TRADEMARK OFFICE

CERTIFICATE OF CORRECTION

PATENT NO. : 5,592,276

DATED : January 7, 1997

INVENTOR(S) : YASUMASA OHTSUKA, ET AL.

It is certified that error appears in the above-indentified patent and that said Letters Patent is hereby corrected as shown below:

Column 1

Line 14, "Applications" should read --Application--.
Line 26, "malfunction" should read --malfunctions--.
Line 28, "to" should read --too--.

Column 3

Line 42, "curer" should read --cutter--.
Line 50, "registor" should read --resistor--.
Line 55, "or" should read --or a--.
Line 55, delete "a", (2nd occurence) --.

Column 4

Line 8, "registor" should read --resistor--.
Line 14, "registor" should read --resistor--; and "in" should read --on--.
Line 17, "registor" should read --resistor--.
Line 24, "registor" should read --resistor--.
Line 59, "a" (second occurrence) should read --an--.

UNITED STATES PATENT AND TRADEMARK OFFICE

CERTIFICATE OF CORRECTION

PATENT NO. : 5,592,276 Page 2 of 2

DATED : January 7, 1997

INVENTOR(S) : YASUMASA OHTSUKA, ET AL.

It is certified that error appears in the above-indentified patent and that said Letters Patent is hereby corrected as shown below:

Column 5

Line 34, "and" should read --which--.
Line 43, "between" should read --between a--.

Column 6

Line 5, delete "it".
Line 47, "heater 3" should read --heater 6--.

Signed and Sealed this

Seventeenth Day of June, 1997

Bruce Lehman

*Attest:*

BRUCE LEHMAN

*Attesting Officer*

*Commissioner of Patents and Trademarks*